US007704003B2

(12) United States Patent
Ziniti et al.

(10) Patent No.: US 7,704,003 B2
(45) **Date of Patent: *Apr. 27, 2010**

(54) LIQUID APPLICATOR

(75) Inventors: Marco F. Ziniti, O'Fallon, IL (US); Garry L. Staub, Swansea, IL (US); Thomas J. Kutsch, Swansea, IL (US)

(73) Assignee: U-Mark, Inc., Belleville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/679,027

(22) Filed: Feb. 26, 2007

(65) Prior Publication Data

US 2007/0201940 A1 Aug. 30, 2007

Related U.S. Application Data

(63) Continuation-in-part of application No. 11/245,858, filed on Oct. 7, 2005, now Pat. No. 7,182,541.

(51) Int. Cl.
*B43K 5/00* (2006.01)

(52) U.S. Cl. ..... 401/206; 401/205

(58) Field of Classification Search ..... 401/198, 401/199, 205, 206

See application file for complete search history.

(56) References Cited

U.S. PATENT DOCUMENTS 3,640,631 A 2/1972 Sotir
5,035,524 A 7/1991 Sakurai
5,082,386 A 1/1992 Hironaka et al.
5,749,665 A 5/1998 Kato et al.
5,888,007 A 3/1999 Nicoll et al.
6,817,802 B2 11/2004 Nishitani et al.
7,086,799 B1 * 8/2006 Pappageorge et al. ..... 401/206
7,182,541 B1 * 2/2007 Ziniti et al. ..... 401/206

* cited by examiner

*Primary Examiner*—David J Walczak
(74) *Attorney, Agent, or Firm*—Polster Lieder Woodruff & Lucchesi, L.C.

(57) ABSTRACT

This liquid applicator (10) provides a container (14) having a valve assembly (50). The valve assembly (50) includes a unitary closure (12) having a passage with a partition (28) dividing the passage into first and second portions (26) and (27) providing a valve opening. A plunger (16) provides a valve element which has an intermediate tapered portion (29) received within the partition (42) opening to provide flow of liquid from the container (14). A spring (20) overfits the plunger (16) and engages a retainer (22) at the end of the closure (12) and a nib (18) interfits the closure first passage (25) to engage the plunger (16) to provide longitudinal movement of the plunger (16) to open the valve assembly (50) to dispense liquid from the container (14) and into the nib (18) when pressure is applied to move the plunger (16) out of the valve opening. A second embodiment includes a comparatively thin wall of the closure (112) adjacent the second chamber (127) and closure (112) may include a flange portion (131) for more evenly distributing the retainer load to the closure wall (127) defining the second chamber (127).

6 Claims, 4 Drawing Sheets

LIQUID APPLICATOR

CROSS-REFERENCE TO RELATED APPLICATIONS

This application is a continuation in part of application Ser. No. 11/245,858 filed on Oct. 7, 2005, now U.S. Pat. No. 7,182,541, the contents of which are expressly incorporated herein by reference.

BACKGROUND OF THE INVENTION

This invention relates generally to liquid applicators and particularly to applicators used to dispense paints, inks, stains, coating adhesives, cleaning compounds, and the like, through a valved nib.

Applicators of the type under consideration have been used since the 1950's and up until the present have always used more than four primary components to be effective.

When assembled, the components of a typical valve actuated applicator operate by pushing the nib inwardly by depressing the nib onto a hard surface. Depressing the nib onto such a surface moves the plunger or valve element backwards against spring action and fluid, primarily liquid, flows from container into the nib. When pressure is released the spring returns the plunger to its original position and flow to the nib is cut off. When thus charged with liquid the nib is ready for use. When the supply of liquid to the nib is exhausted the nib must be recharged by depressing it again on the hard surface.

A patent pertinent to the second embodiment is U.S. Pat. No. 3,640,631 issued to Sotir. A distinct improvement of the applicants' second embodiment over the Sotir patent is that in Sotir the entry of the applicator liquid to the nib is primarily by way of a lateral passage 52 into a secondary reservoir and into the end of the nib. One of the disadvantages with the Sotir structure is that the lateral passage is prone to clogging when used with viscous paints or adhesives therefore Sotir is limited to thinner fluids. The present structure, on the other hand, provides an ample supply of ink through an annular area at the end of the nib and also into the nib through channels in the closure structure without the need for a secondary reservoir.

The difference between the current applicator and prior art applicators lies in the number of components necessary to provide a working device, and in the relationship of such components to each other. The prior art applicators require additional and more complicated parts than the present applicator.

This liquid applicator overcomes the disadvantages noted above in a manner not revealed by the known prior art by requiring a smaller number of less complicated applicator parts.

SUMMARY OF THE INVENTION

This liquid applicator requires only four components, in addition to the nib, to work effectively. These four components are a closure, a plunger or valve element, a spring and a retainer. When assembled in proper order in a container, which provides the applicator body, the applicator works effectively as a valve to regulate flow from the container to the nib. In addition to the four components and the nib, only a cap is necessary, as an addition, to prevent the applicator from drying out when not in use.

This invention is a liquid applicator comprising a container for dispensable liquid, the container having an open end and a closed end with a valve assembly inserted at the open end.

The valve assembly includes the closure interfitting the open end of the container and having a passage extending therethrough and a partition with an opening, the partition dividing the passage into first and second communicating portions; a valve element interfitting the opening, and cooperating with the opening to provide a valve as the valve element moves in said opening, the closure including a retainer at the inner end; a spring disposed between the retainer and the valve element to bias the valve element against inward movement of the valve element. A nib is disposed in sliding relation in the first passage and is engageable with the valve element whereby the valve element is movable by pressure of the nib against the bias of the spring to open the valve and allow liquid to flow into the nib and the valve to close when pressure is released.

It is an aspect of this invention to provide that the valve element has an intermediate tapered portion received within the opening, whereby the flow of liquid is variable.

It is another aspect of this invention to provide that the valve element has a stop engageable by the spring.

It is still another aspect of this invention to provide that the retainer has an opening allowing flow of the applicator liquid from the container therethrough and another aspect to provide that the closure includes a socket at the inner end thereof receiving the retainer in retained relation.

It is yet another aspect of this invention to provide that the first part of the closure passage provides a reservoir for the liquid and also provides a plurality of longitudinal ribs facilitating movement of the nib within said passage.

It is another aspect of this invention to provide that the valve element has a reduced diameter inner end, and to provide that the retainer has a central opening sized to receive the reduced diameter inner end of the valve element in sliding relation to maintain alignment of said valve element.

It is still another aspect of this invention to provide that the valve element has a reduced diameter outer end and a bore defining an annular face for receiving the end of the nib.

It is still another aspect of this invention to provide that the valve element has a reduced diameter outer end received by the first passage to define a reservoir between the closure and the engaged end of the valve element.

It is an aspect of this invention to provide a cap adapted to overfit the closure and slidingly engage with the closure to maintain alignment of the cap and inhibit drying out of the nib.

This liquid applicator is simple in construction because of the reduction in component parts, and it is easy to manufacture and use for the same reason.

It is an aspect of this invention to provide a proper fit of the aluminum container and the closure to prevent liquid leaks. Leakage may be due to the extremes of temperature in which the applicator is used and particularly because aluminum of the container and the plastic of the closure have different coefficients of expansion. In order to resolve this problem the relative mass of the closure and the container in contact have been considered. Experiments have shown that an internal pressure applied by the retainer to the closure wall produces beneficial results because it keeps the plastic closure wall closer to the aluminum container wall during the critical thawing time. This is achieved by providing superior engagement. Another aspect of the "proper fit" is to prevent the closure from being pulled out of the container altogether. When the applicator is frozen and then thawed at room temperature pulling the cap out may carry the entire closure with it due to the differential in the coefficient of expansion of plastic and aluminum. Superior engagement is achieved by the relationship between the closure wall thickness and the container wall thickness.

DESCRIPTION OF A PREFERRED EMBODIMENT

Figure 1:
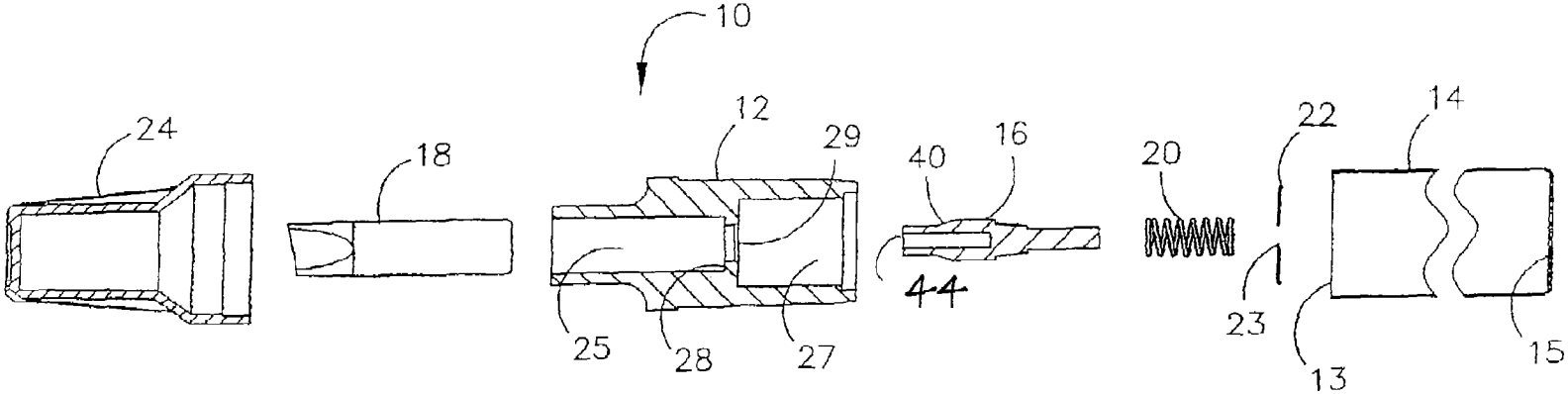
FIG. 1 is an exploded view of the liquid applicator in longitudinal cross-section.

Referring now by reference numerals to the drawings and first to FIG. lit will be understood that the liquid applicator 10 includes a unitarily formed, one-piece closure member 12 formed from hard plastic material such as acetal plastic which interfits the open end of a container 14. The container is a hollow cylinder having an open end 13 and a closed end 15 and is preferably of metal such as aluminum. Acetal plastic is impervious to most fluids and solvents.

The closure 12 includes a passage 26 therethrough having a partition or web 28 dividing the passage into first and second portions 25 and 27 communicating with each other by means of an opening 29. The opening 29 receives the front end of the valve element or plunger 16 in sliding relation and the socketed rear end of the closure 12 is provided with the fixedly attached retainer 22. A spring 20, constituting a bias means, is received on the rear end of the plunger 16 and engages the retainer 22. The front end of the plunger 16 is engaged by the nib 18 to apply pressure to the nib 18 to open the valve. Preferably, the plunger 16 is made of low density polyethylene, a softer material which facilitates an effective seal. The spring 20 may be a coil spring and the pressure may be controlled by varying the number of coils on the spring.

The closure 12, the plunger 16, the spring 20 and the retainer 22 constitute a valve assembly 50 which interfits tightly into the open end 13 of the liquid container 14. The cap 24 may be made of plastic or metal.

Figure 2:
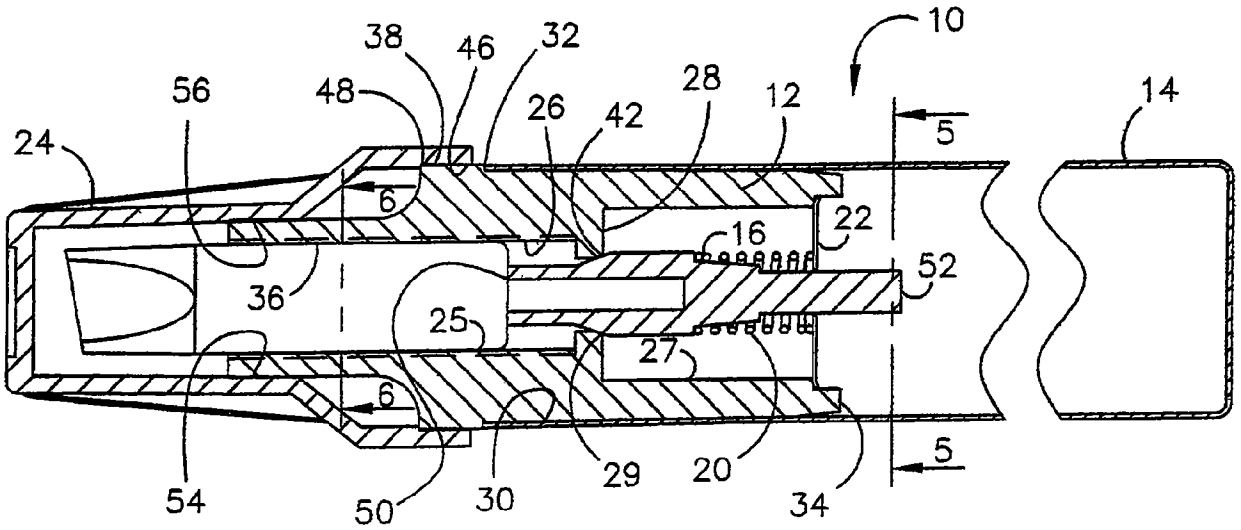
FIG. 2 is a view of the assembled components in longitudinal cross-section.

More specifically, as shown in FIG. 2, the closure 12 includes a reduced diameter portion 30 to provide a shoulder 32 which acts as a stop for the container 14. At its rear end 34 the closure 12 is tapered so that it is readily received by the container 14.

Figure 6:
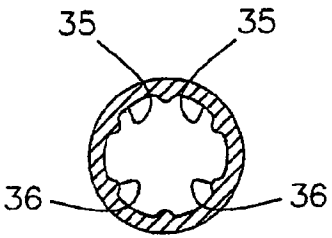
FIG. 6 is a cross-sectional view taken on line 6-6 of FIG. 2, nib not shown.
Figure 5:
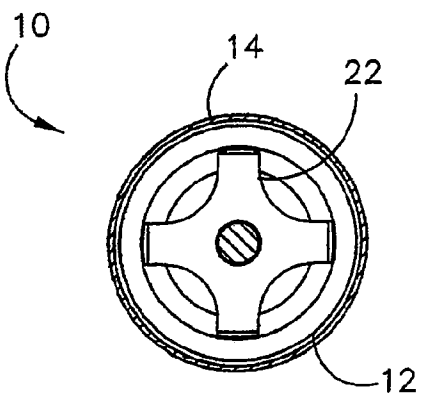
FIG. 5 is a cross-sectional view taken on line 5-5 of FIG. 2.

At its front end the closure 12 first passage portion 25 is adapted to receive the nib 18 as a push fit so that it slides within the passage 25 under resistance from the spring 20 against the retainer 22. To this end, the passage 25 is fluted to provide a plurality of longitudinal ribs 36 and recesses 35, as shown in FIG. 6, the ribs providing a bearing surface and the recesses receiving liquid to increase the lubricating of the nib 18.

Figure 7:
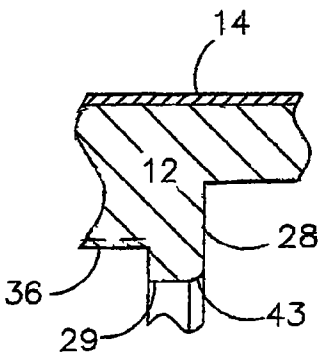
FIG. 7 is an enlarged detail showing the configuration of the valve opening.

The plunger 16 is configurated so that it is received in an opening 29 in web 28 extending across the inside of the closure 12. As shown in FIG. 2 the plunger 16 includes a tapered portion 42, which interfits the opening the web opening 29 to provide a variable diameter of annular opening depending on longitudinal movement of the tapered portion 42 of the plunger 16 within the opening 29. The rim of the opening 29 may also be tapered at 43 to provide a graduated opening as shown in FIG. 7. The forward end 44 of the plunger is reduced relative to the tapered intermediate portion 42 in order to provide the tapered rim 43 and the rearward end of the plunger 16 is suitably configurated with a shoulder 17, constituting a stop, to receive the spring 20 such that the end 52 of the plunger 16 projects outwardly of the retainer 22 when the applicator is depressed. The spring 20 is preferably of hardened steel and the retainer 22 is also of hardened spring steel.

Figure 10:
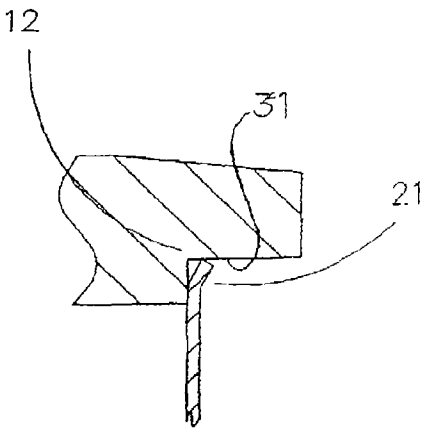
FIG. 10 is an enlarged detail showing the retainer fitted into the closure socket.
Figure 9:
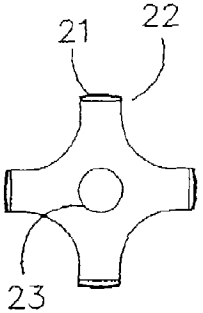
FIG. 9 is an enlarged detail showing the retainer.
Figure 8:
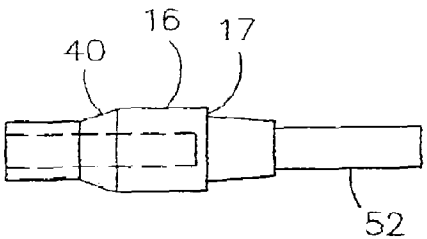
FIG. 8 is an enlarged detail showing the valve element.

As shown in FIGS. 9 and 10, the retainer 22 is of a cruciform configuration having open areas providing for liquid flow, and with outer lips 21 bent as shown in FIG. 10. It is important that the retainer have sufficient open area allowing liquid flow consistent with the application of flex on the closure wall thickness. The retainer is of a diameter slightly greater than the diameter of the socket 31 so that once sprung in place it cannot be readily removed.

The cap 24 is configurated to interfit the closure 12 at two longitudinal spaced places. To this end the cap 24 is indented to provide a shoulder 48 extending to the cap end 46, and engaging with the intermediate closure seating portion 38 and a seating portion 54 adapted to overfit the closure forward portion 56.

Figure 3:
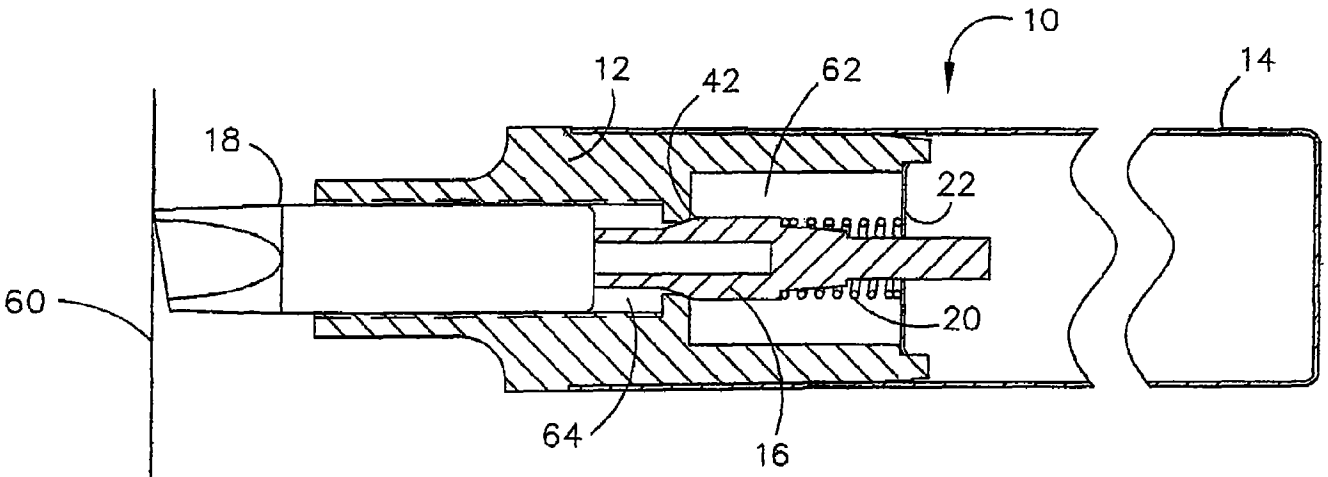
FIG. 3 is a view similar to FIG. 2 but with the cap removed and before the valve is actuated.
Figure 4:
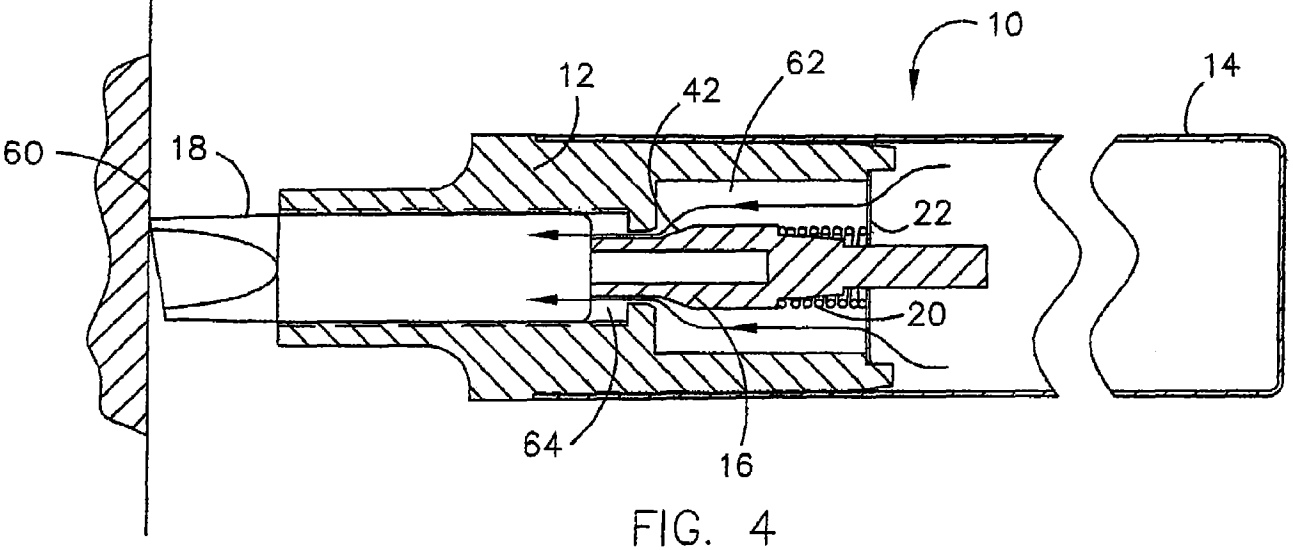
FIG. 4 is a similar view to FIG. 3 but with the nib depressed against a hard surface to actuate the valve system.
Figure 11:
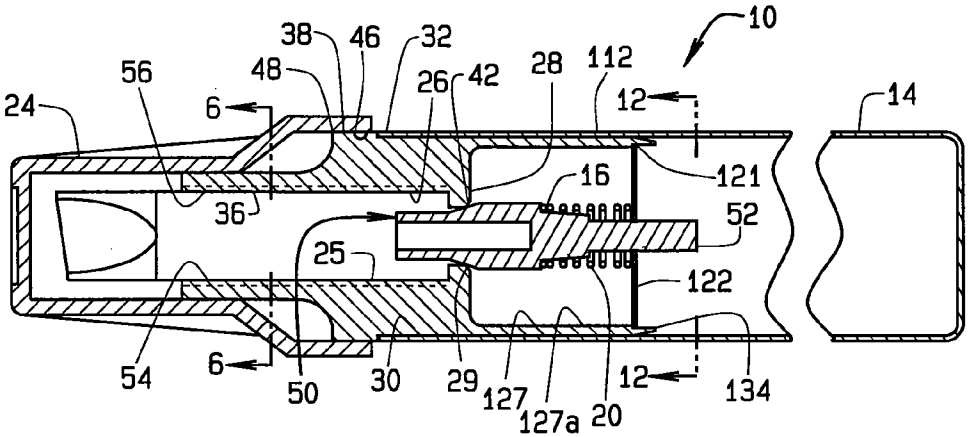
FIG. 11 is a view of the assembled components in longitudinal cross-section.

In order to fully understand the structure of the liquid applicator 10, and particularly the valve action, reference is made to FIG. 3 and FIG. 4, which illustrate the valve in its closed and open position respectively.

In both FIG. 3 and FIG. 4 the cap 24 is removed for clarity. FIG. 3 illustrates the liquid applicator immediately before pressing the nib 18 against a hard surface 60. The spring 20 is in its unloaded position and there is no inward pressure on the nib 18 tending to compress the spring 20 and open the valve.

Turning now to FIG. 4, when the liquid applicator 10 is moved to the left against the hard surface 60, the nib 18 pushes against the plunger 16, compresses the spring 20 and moves tapered surface 42 of the plunger 16 to the right and through the retainer opening 23 and out of the tapered opening 29, 43 so that it opens the valve opening and permits liquid from the container 14 to move from the liquid chamber 62 and into the reservoir chamber 64 to the right of the nib 18, as shown by the arrows, to charge the nib 18 with liquid and also allow for a small amount of liquid to be received by the plunger. This movement facilitates reversal of the nib end-to-end, in the event that this is desired. When pressure on the nib 18 is released, the spring 20 moves the plunger 16 to the left and closes the valve. Preferably the nib is made from fiber.

It may take two or three depressions of the plunger 16 to open and close the valve to ensure that the nib 18 is fully charged and ready for use. The number of depressions is determined by the viscosity of the liquid, the porosity of the nib and will also depend on how long the plunger is depressed. When the nib 18 is discharged of liquid, the valve assembly 50 can again be charged or it can be closed and the cap 24 replaced.

Figure 12:
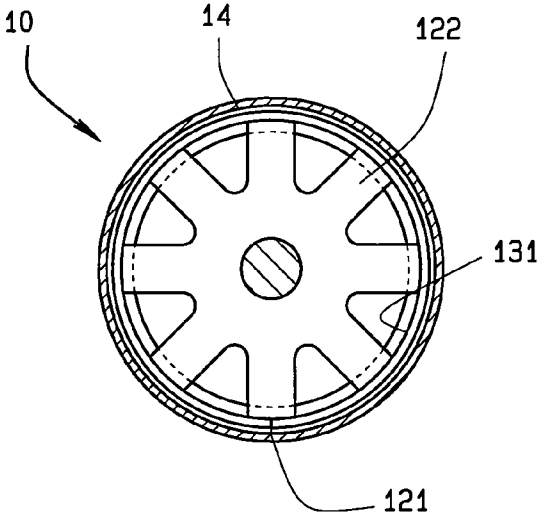
FIG. 12 is a cross-sectional view through line 12-12 of FIG. 11.
Figure 13:
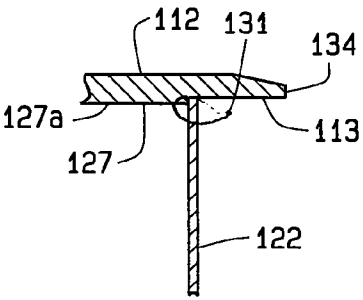
FIG. 13 is an enlarged detail showing the retainer fitted into the closure socket.
Figure 14:
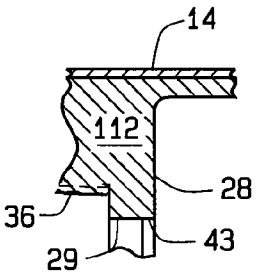
FIG. 14 is an enlarged detail showing the configuration of the reduced thickness of a portion of the closure.

A second embodiment is shown in FIGS. 11-14. This embodiment is intended for situations in which there may be a substantial differential in the ambient temperature in which the liquid applicator is to be used and in which therefore there is a greater susceptibility to leakage. Also the closure of the present FIGS. 11-14 is similar to FIGS. 2-5, 7 and 10 except for the important differences clearly illustrated in FIGS. 11-14. In particular, the closure 112 and the retainer 122 of the second embodiment are proportioned differently from closure 12 and retainer 22 of the first embodiment and the differences are indicated by the addition of prefix 1. For example, in FIG. lithe closure wall portion 127*a* defining the liquid chamber 127 adjacent the liquid container 14 is much thinner than the comparable closure 12 shown in FIG. 2. In addition, under some circumstances the retainer 122 may be formed with eight spokes providing eight supporting edges 121 as shown in FIG. 12 rather than four supporting edges 21 as shown in FIG. 9. The reason for this is to distribute the load from the retainer 122 to the wall of 127 the closure 112 more evenly to provide a better seal with the container 14. The open spaces through which applicator liquid flows is still great enough to provide sufficient flow area of about 20% of the area of the retainer. Optionally, a continuous closure flange 131 can be provided for the retainer together with a plurality of openings spaced about the stem 52 to increase the liquid flow area through the retainer 122. The thickness of the closure wall 127*a* is in the range of 0.02"-0.04". Ideally, the thickness of the closure wall is 0.029" compared to the thickness of the adjacent container skin of about 0.015". It will be understood that the thicknesses noted above are for a particular size of liquid applicator nominally with a three-quarter inch barrel.

Ideally, the closure wall thickness should be no more than 2½ times the thickness of the container wall 14. The thickness of the retainer 122 should ideally be about 0.009". Also the closure of the present structure provides a unitary one-piece component. It will be understood that some experimentation may be necessary within the scope of the claims hereunto expended.

In view of the above it will be seen that various aspects and features of the invention are achieved and other advantageous results attained. While a preferred embodiment of the invention has been shown and described, it will be clear to those skilled on the art that changes and modifications may be made therein without departing from the invention in its broader aspects as defined by the claims.

We claim as our invention:

1. A liquid applicator comprising:

a. a container for dispensable liquid, the container having at least one open end;

b. a valve assembly including:

i) a unitary, one piece closure inserted at an open end of the container and the closure having a passage extending therethrough and a partition with an opening, the partition dividing the passage into first and second communicating passage portions defining first and second reservoirs;

ii) a valve element inserted at the partition opening and cooperating with the opening to provide a valve as the valve element moves in said opening, the closure including a substantially planar retainer at an inner end;

iii) bias means disposed between the retainer and the valve element to bias the valve element against inward movement of the valve element; and c. a nib disposed in sliding relation in a first passage portion and being operatively engageable with the valve element whereby the valve element is movable by pressure of the nib against the bias of the bias means to open the valve and allow liquid to flow into the nib and allow the valve to close when pressure is released; and d. the retainer has a plurality of spokes and includes an open area to receive liquid therethrough sufficient to supply an ample flow of liquid therethrough said closure wall thickness adjacent the container in the vincinity of the second reservoir is in the range of 0.020-0.040 inches for a container having a body diameter of about 0.75 inches to provide for substantial differential in ambient temperature.

2. A liquid applicator as defined in claim 1, wherein a closure wall thickness diametrically adjacent the container is plastic and is no more than 2½ times the thickness of the container wall in the vicinity of the second reservoir.

3. A liquid applicator comprising:

a. a container for dispensable liquid, the container having an open end and a closed end;

b. a valve assembly including:

i) a unitary, one piece closure inserted at the open end of the container and having a passage extending therethrough and a partition with an opening, the partition dividing the passage into first and second communicating passage portions defining first and second reservoirs;

ii) a valve element interfitting the partition opening and cooperating with the opening to provide a valve as the valve element moves in said opening, the closure including a substantially planar retainer fining into said opening, in an inner end and including means holding the retainer in place;

iii) a spring disposed between the retainer and the valve element to bias the valve element against inward movement of the valve element; and c. a nib disposed in sliding relation in a first passage portion and being operatively engageable with the valve element whereby the valve element is movable by pressure of the nib against the bias of the spring to open the valve and allow liquid to flow into the nib from an end and sides of the nib and allow the valve to close when pressure is released; and d. the retainer has a plurality of spokes and includes an open area to receive liquid therethrough sufficient to supply an ample flow of liquid therethrough wherein the closure in the vicinity of the second reservoir is about 0.029 inches thick for a container having a body diameter of about 0.75 inches.

4. A liquid applicator as defined in claim 3, wherein the plurality of spokes is 8.

5. A liquid applicator as defined in claim 3 wherein the retainer has a thickness of about 0.009 inches.

6. A liquid applicator as defined in claim 3 wherein the retainer has liquid passage area of about 20% of the retainer area.

* * * * *